US006050259A

United States Patent [19]

Reyher

[11] Patent Number: 6,050,259

[45] Date of Patent: Apr. 18, 2000

[54] GAS FIREPLACE

[75] Inventor: Russell E. Reyher, Winnipeg, Canada

[73] Assignee: R-Co Inc., Winnipeg MB, Canada

[21] Appl. No.: 09/323,900

[22] Filed: Jun. 2, 1999

[30] Foreign Application Priority Data

Feb. 12, 1998 [CA] Canada ..... 2229254

[51] Int. Cl.[7] ..... F24B 1/189

[52] U.S. Cl. ..... 126/515; 126/85 B

[58] Field of Search ..... 126/515, 85 B

[56] References Cited

U.S. PATENT DOCUMENTS 5,191,877 3/1993 Shimek et al. ..... 126/515
5,307,801 5/1994 Schroeter et al. ..... 126/515
5,647,342 7/1997 Jamieson et al. ..... 126/515
5,947,113 9/1999 Beal et al. ..... 126/515

*Primary Examiner*—Carroll Dority
*Attorney, Agent, or Firm*—Murray E. Thrift; Adrian D. Battison; Michael R. Williams

[57] ABSTRACT

A direct vent gas fireplace has a combustion air supply duct extending down the back wall, on the outside of the housing back wall. It is connected to the firebox by a duct assembly with a flange that connects to the housing and two ducts that connect to the firebox. The supply duct is located laterally between two cooling air ducts that lead from the cool air zones at the bottom outer corners of the housing to a cooling air plenum inside the top of the housing. Inside the cooling air plenum and the cooling air ducts are a room air plenum and room air circulating space for the circulation of room air to be heated. This provides a compact construction with adequate wall cooling without the need for additional thermal insulation.

9 Claims, 3 Drawing Sheets

GAS FIREPLACE

FIELD OF THE INVENTION

The present invention relates to fireplaces and more particularly to direct vent gas fireplaces.

BACKGROUND

With direct vent gas fireplaces, it is preferred to minimize the clearance required between the unit and combustible materials. The ideal is "zero clearance". To achieve this, fireplaces have been constructed with wrappings of thermal insulation and plural circulation chambers around the firebox. The air chambers heat room air as well as providing insulation. This increases the overall size of the fireplace, making the unit project some distance into a room when installed in a standard stud wall.

The applicant's Canadian patent application 2,205,242, filed May, 13, 1997 discloses a direct vent gas fireplace with an outer sheet metal housing a vertical outer back wall and a sloped outer top wall sloping upwardly from the outer back wall towards a front side of the housing. An inner sheet metal fire box is located inside the outer housing and has a vertical inner back wall spaced from the outer back wall of the housing. There is a combustion air inlet through the inner vertical back wall, adjacent its bottom end. A sloped inner top wall slopes upwardly from the inner back wall toward a front side of the fire box and is spaced from the outer top wall. A combustion air supply includes a plenum on top of the outer top wall and a duct extending from the plenum between the outer and inner back walls to the combustion air inlet. Two cooling air ducts are located between the inner and outer back walls on opposite sides of the combustion air duct and have inlets between the bottom of the outer housing and the inner bottom wall, and adjacent the respective side walls.

The combustion air duct and the cooling air ducts are thus arranged side by side in the back wall in order to reduce the depth of the unit. The cooling air is drawn from the bottom outside corners of the unit, below the firebox. The air in this area is the coolest available for supply to the cooling air ducts. This arrangement allows a reduction in the back wall thickness, while maintaining adequately low temperature levels on the outer back wall, even without a layer of thermal insulation in or on the back and top walls.

The present invention is concerned with certain improvements in direct vent gas fireplaces of this type.

SUMMARY

According to the present invention there is provided a fireplace comprising:

an outer housing with:
- a bottom,
- an outer back wall having an outer combustion air inlet opening therethrough, and
- an outer top wall extending from the outer back wall towards a front side of the housing;

an inner fire box inside the outer housing and with:
- an inner back wall spaced from the outer back wall of the housing, the inner back wall having an inner combustion air inlet therethrough, adjacent a bottom end of the inner back wall and aligned with the outer combustion air inlet,
- an inner top wall extending from the inner back wall toward a front side of the fire box and spaced from the outer top wall,

- an inner bottom wall spaced from the bottom of the housing;

combustion air supply passage comprising a combustion air plenum on top of the outer top wall and a supply duct extending from the plenum along a back side of the outer back wall to the outer combustion air inlet;

combustion air inlet means for delivering combustion air from the outer combustion air inlet through the inner combustion air inlet to the interior of the firebox; and two cooling air ducts between the inner and outer back walls on opposite sides of the supply duct and having inlets between the bottom of the outer housing and the inner bottom wall, and adjacent the respective side walls.

In the preferred embodiments of the invention, the cooling air ducts are spaced from the back wall of the firebox so that a room air flow can be generated around the firebox, transferring heat from the firebox to the circulated room air and providing an additional cooling air flow, further insulating the housing from the hot firebox.

The combustion air inlet means may be at least one duct with two mounting flanges secured to opposite ends of the duct. The mounting flanges are fastened to the inner back wall and the outer back wall respectively. This provides for a significantly simplified assembly process. The duct assembly is easily mounted on the firebox for assembly into the outer housing with the firebox. The external supply duct is also simpler to install than the earlier internal duct. The preferred arrangement uses two spaced apart cylindrical ducts and rectangular mounting flanges. This can be manufactured simply, providing a robust subasssembly with good air capacity

BRIEF DESCRIPTION OF THE DRAWINGS

In the accompanying drawings, which illustrate an exemplary embodiment of the present invention.

DETAILED DESCRIPTION

Figure 1:
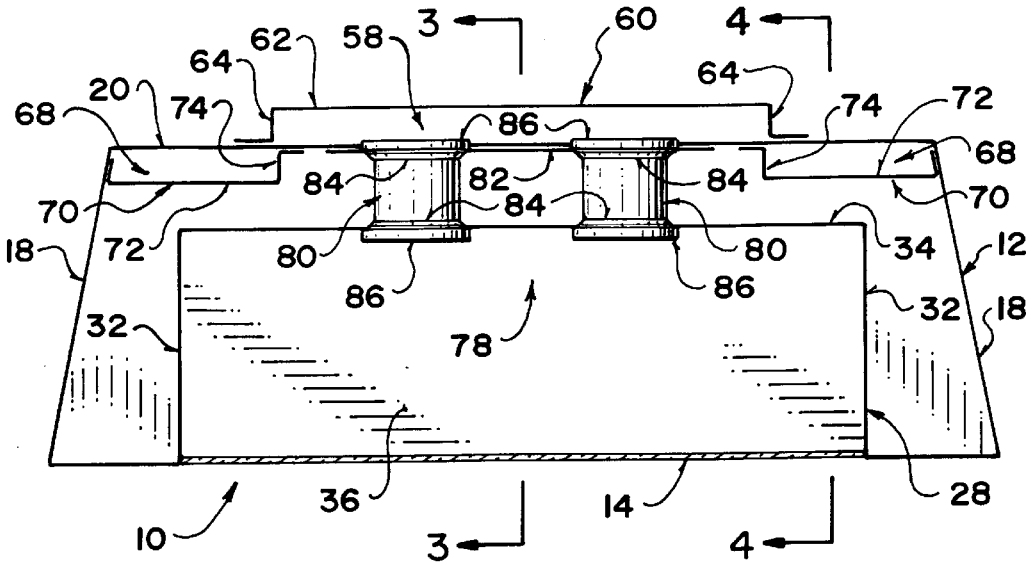
FIG. 1 is a plan view in cross-section of a fireplace unit according to the present invention.
Figure 2:
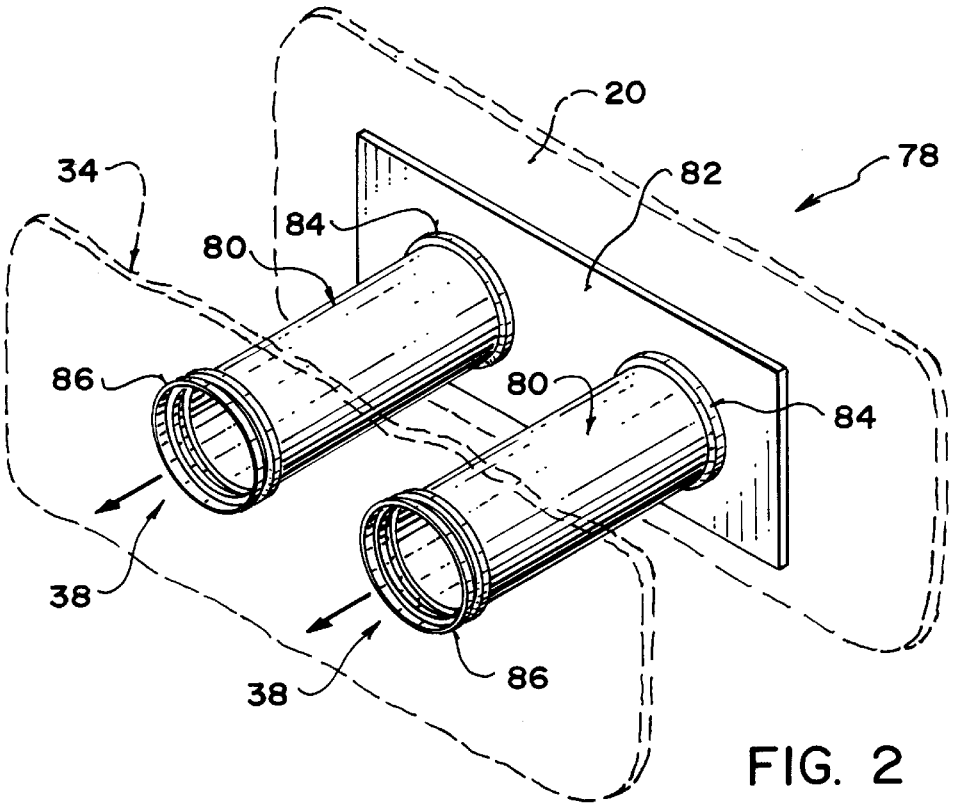
FIG. 2 is an isometric view of a combustion air inlet assembly
Figure 3:
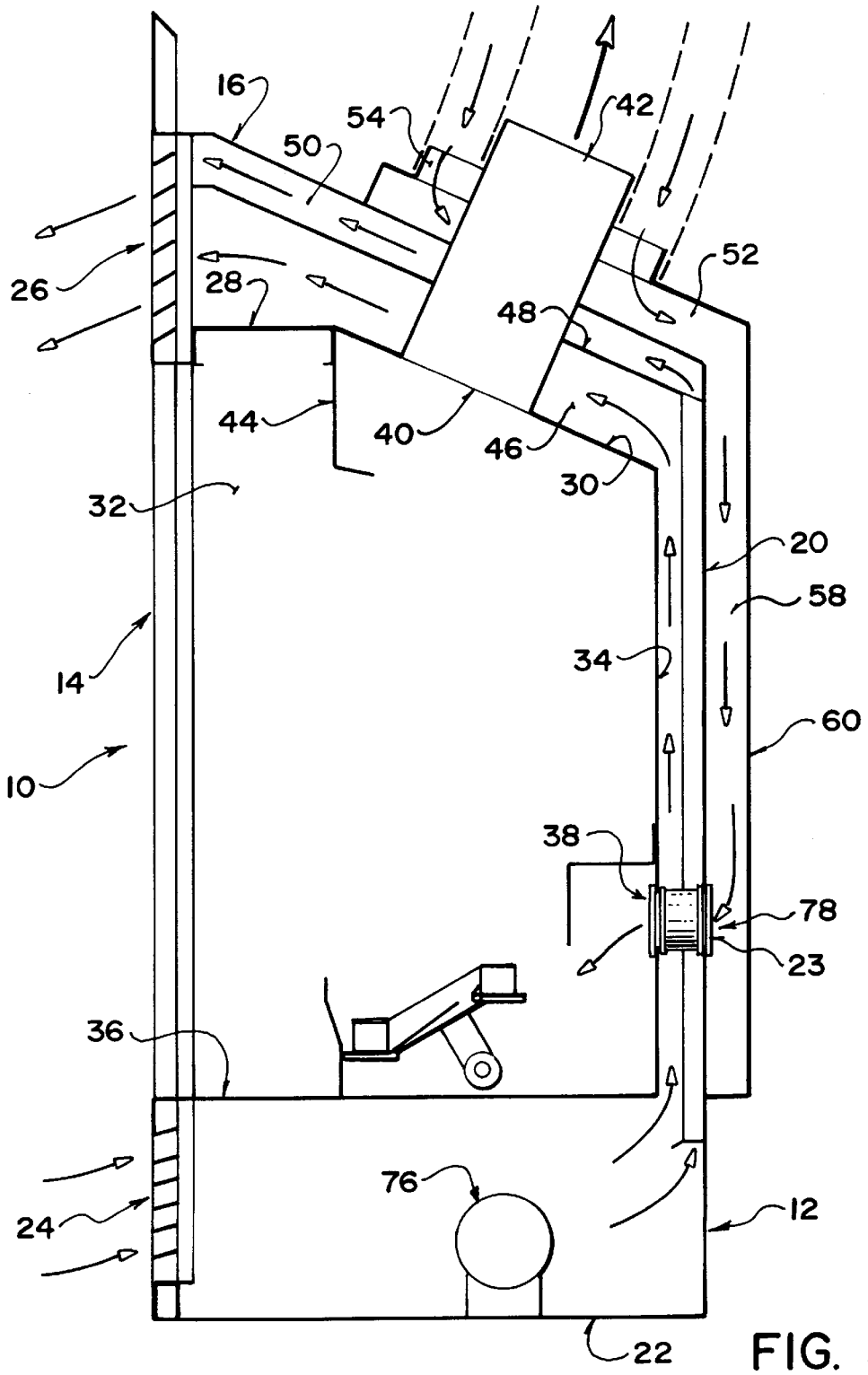
FIG. 3 is a side elevation in cross-section along line 3—3 of FIG. 1.
Figure 4:
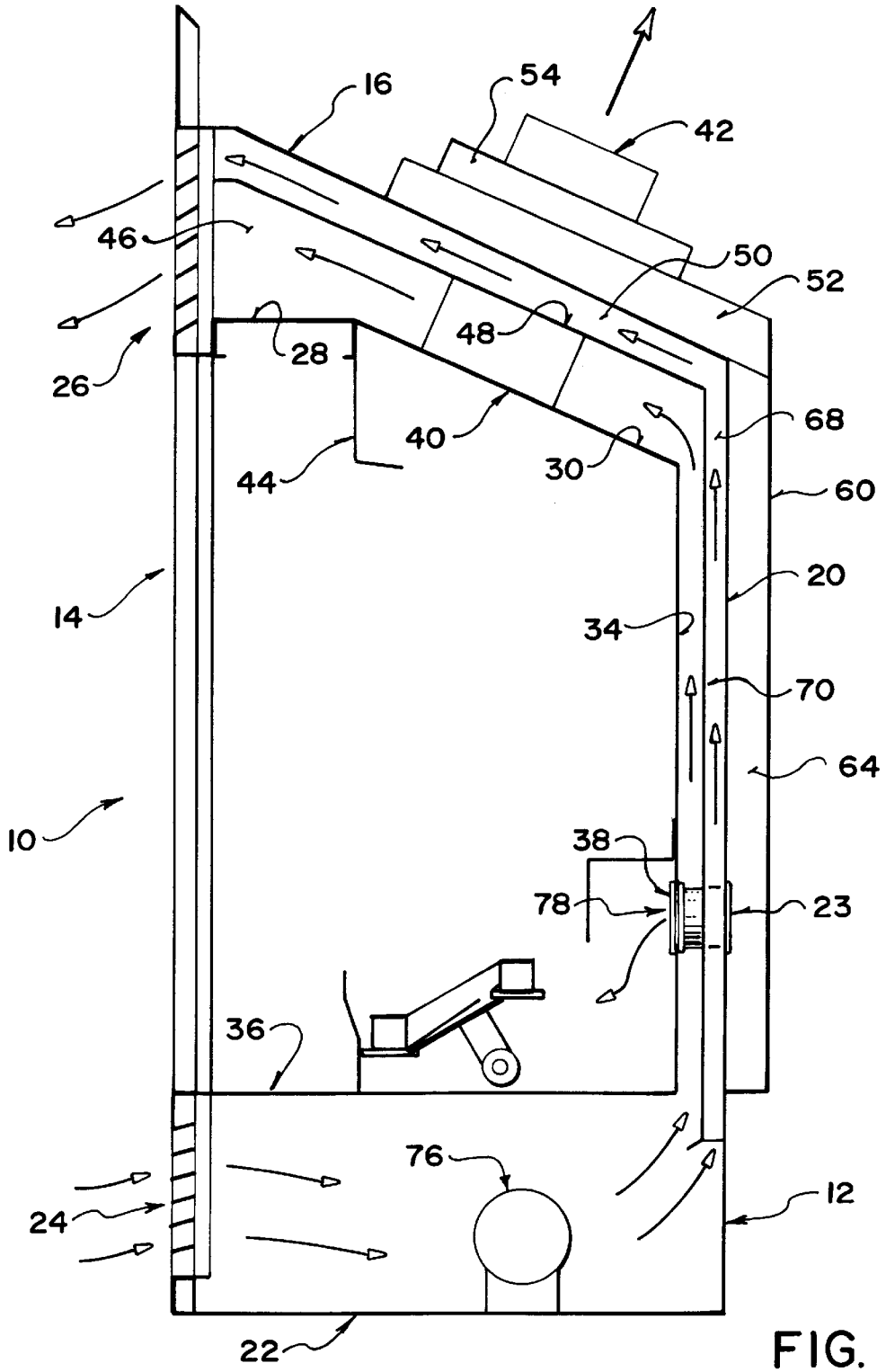
FIG. 4 is a side elevation in cross-section along line 4—4 of FIG. 1.

Referring to the accompanying drawings, there is illustrated a fireplace 10 with an outer sheet metal housing 12 having a glazed front wall 14 through which a fire may be viewed. The housing has a top wall 16 that slopes downwardly to the back. The housing also has two rearwardly convergent side walls 18, a back wall 20 and a bottom wall 22. Two circular air inlet openings 23 in the back wall 20 are located centrally between the side walls and above the bottom wall 22. In the front of the housing, below the glass front is a room air inlet 24. Above the glass in the front wall is a warm air discharge 26.

Inset into the housing 12 above the air inlet 24 and below the air discharge 26 is a sheet metal firebox 28. This includes a top wall 30 with a back part that slopes down to the rear, parallel to the top wall 16. Two parallel side walls 32, a back wall 34 and a bottom wall 36 are all spaced inwardly from the corresponding walls of the housing 12. Near the bottom of the back wall 34 are two circular combustion air inlet openings 38, aligned with the outer combustion air inlets 23 in the back wall 20.

In the top wall 30 of the firebox is an exhaust gas outlet 40. This is connected to an exhaust duct 42. Extending across the firebox in front of the outlet 40 is a baffle 44 for controlling the flow of exhaust gases through the exhaust duct.

The exhaust duct passes through a room air plenum 46 between the firebox top wall 30 and a plate 48 parallel to the top wall 16 of the housing. The exhaust duct also passes through a cooling air plenum 50 between the plate 48 and the top wall 16 of the housing and through a combustion air plenum 52 on top of the housing top wall 16. The top of the combustion air plenum 52 carries an annular fitting 54 for connection to a combustion air vent pipe for drawing in fresh outside air for combustion.

On the back side of the back wall 20 is a combustion air supply duct 58, leading to the combustion air inlet 23 from the combustion air plenum 52. This is a sheet metal channel 60 with a web 62 and two flanges 64 that project from the web into engagement with the outer back wall 20. The flanges are fastened to the outer back wall 20.

On opposite sides of the combustion air supply duct 58 and inside the back wall 20 are two cooling air ducts 68. These are sheet metal channels 70 with webs 72 between the back walls 20 and 24 and edge flanges 74 that project into engagement with the outer back wall 20 where they are fastened in place. The webs 72 are connected to the back edge of the plate 48 so that air passing through the ducts 68 will pass through the cooling air plenum 50 to the air discharge 26 at the front of the housing.

The cooling air ducts are arranged to draw air from the areas near the bottom wall 22 of the housing 12. This is the coolest area within the housing so that the coolest possible air can be passed through the cooling air ducts to minimize the temperature of the outer back wall and the top wall 16.

A blower 76 between the bottom walls blows room air through ducts 68 and through the space between ducts 68, back wall 20 and the firebox back wall 34. The latter flow passes through the room air plenum 46 to the warm air discharge 26. This air flow picks up heat from the firebox as it passes through the housing.

The two combustion air inlets are coupled with an air inlet assembly 78. This assembly includes two parallel sheet metal tubes 80 connected at their outer ends to a rectangular flange 82. The flange and the back wall 34 of the firebox are each coupled to the tubes between two ribs on the tube. The inner rib 84 is pre-formed and the outer rib 86 is formed on the end of the tube once the back wall 34 or flange 82 is in place. The flange may be mounted first and then the unit attached to the firebox before its insertion into the outer housing. Subsequently, the combustion air supply duct is installed on the back side of the back wall 20, which is also simpler than the prior procedure of mounting the air duct inside the housing before the firebox is installed.

While one embodiment of the present invention has been described in the foregoing, it is to be understood that other embodiments are possible within the scope of the invention and are intended to be included herein. The invention is to be considered limited solely by the scope of the appended claims.

I claim:

1. A fireplace comprising:

an outer housing with:

a bottom, an outer back wall having an outer combustion air inlet opening therethrough, and an outer top wall extending from the outer back wall towards a front side of the housing;

an inner fire box inside the outer housing and with:

an inner back wall spaced from the outer back wall of the housing, the inner back wall having an inner combustion air inlet therethrough, adjacent a bottom end of the inner back wall and aligned with the outer combustion air inlet, an inner top wall extending from the inner back wall toward a front side of the fire box and spaced from the outer top wall, an inner bottom wall spaced from the bottom of the housing;

combustion air supply passage comprising a combustion air plenum on top of the outer top wall and a supply duct extending from the plenum along a back side of the outer back wall to the outer combustion air inlet;

combustion air inlet means for delivering combustion air from the outer combustion air inlet through the inner combustion air inlet to the interior of the firebox; and two cooling air ducts between the inner and outer back walls on opposite sides of the supply duct and having inlets between the bottom of the outer housing and the inner bottom wall, and adjacent the respective side walls.

2. A fireplace according to claim 1 including a cooling air plenum between the inner and outer top walls, leading from the cooling air ducts to a warm air discharge.

3. A fireplace according to claim 2 including an exhaust gas outlet extending outwardly from an opening in the inner top wall through the cooling air and combustion air plenums, and a fresh air inlet concentric with the exhaust gas outlet and communicating with the combustion air plenum.

4. A fireplace according to claim 1 wherein the supply duct comprises a sheet metal channel with a web spaced from the outer back wall and two flanges projecting from the web and secured to the outer back wall.

5. A fireplace according to claim 2 including a space between the cooling air ducts and the inner back wall and a room air plenum between the cooling air plenum and the inner top wall, extending from said space to the warm air discharge.

6. A fireplace according to claim 5 including means for blowing air through said space and the room air plenum.

7. A fireplace according to claim 1 wherein the combustion air inlet means comprise at least one duct and a mounting flange secured to an end of the duct, the mounting flange being fastened to the outer back wall.

8. A fireplace according to claim 7 wherein the combustion air inlet means comprises two spaced apart ducts.

9. A fireplace according to claim according to claim 7 wherein the mounting flange is rectangular.

* * * * *